US009856584B2

(12) United States Patent
Carrara et al.

(10) Patent No.: US 9,856,584 B2
(45) Date of Patent: Jan. 2, 2018

(54) YARNS FOR PROTECTIVE TEXTILES, AND MANUFACTURING METHODS THEREOF

(71) Applicant: FILTES INTERNATIONAL S.r.l. CON SOCIO UNICO, Capriolo (IT)

(72) Inventors: Sergio Carrara, Brescia (IT); Giuliano Gandossi, Brescia (IT)

(73) Assignee: FILTES INTERNATIONAL S.R.L. CON SOCIO UNICO, Capriolo (BS) (IT)

( * ) Notice: Subject to any disclaimer, the term of this patent is extended or adjusted under 35 U.S.C. 154(b) by 413 days.

(21) Appl. No.: 14/529,212

(22) Filed: Oct. 31, 2014

(65) Prior Publication Data

US 2015/0118475 A1 Apr. 30, 2015

(30) Foreign Application Priority Data

Oct. 31, 2013 (IT) ..... BS2013A0157

(51) Int. Cl.

| | |
|---|---|
| ***D02G 1/08*** | (2006.01) |
| ***D01G 1/08*** | (2006.01) |
| ***D02G 3/18*** | (2006.01) |
| ***D02G 3/38*** | (2006.01) |
| ***D01H 5/70*** | (2006.01) |
| ***D02G 3/44*** | (2006.01) |

(52) U.S. Cl.

CPC ..... *D01G 1/08* (2013.01); *D01H 5/70* (2013.01); *D02G 3/182* (2013.01); *D02G 3/38* (2013.01); *D02G 3/442* (2013.01); *Y10T 428/249921* (2015.04)

(58) Field of Classification Search

CPC ..... D02G 3/182; D02G 3/38; D02G 3/442; D01G 1/08; D01H 5/70

See application file for complete search history.

(56) References Cited

U.S. PATENT DOCUMENTS

| | | | | |
|---|---|---|---|---|
| 4,837,117 | A * | 6/1989 | Armiger | C03C 25/26 428/361 |
| 2004/0081825 | A1 | 4/2004 | Perrotto et al. | |
| 2006/0165982 | A1* | 7/2006 | Simmonds | D01G 1/08 428/364 |
| 2006/0204753 | A1* | 9/2006 | Simmonds | D01G 1/08 428/364 |

FOREIGN PATENT DOCUMENTS

| | | | |
|---|---|---|---|
| EP | 0564331 | A1 | 10/1993 |
| JP | H03146730 | A | 6/1991 |
| JP | H04361636 | A | 12/1992 |
| WO | 8901999 | A1 | 3/1989 |

* cited by examiner

*Primary Examiner* — Shaun R Hurley
(74) *Attorney, Agent, or Firm* — Robert E. Alderson, Jr.

(57) ABSTRACT

Methods for making yarns are provided which include the steps of supplying continuous polymer filaments, detaching from at least a part of the continuous polymer filaments, and at least one continuous reinforcement filament, a plurality of discontinuous polymer fibers and of discontinuous reinforcement fibers to obtain a composite sliver, and twisting the composite sliver to obtain a roving from which yarn may be obtained. Yarns produced by such methods as well as textiles, fabrics and garments which include such yarns are also provided. Such yarns may be particularly useful in the production of, for example, protective gloves.

13 Claims, 1 Drawing Sheet

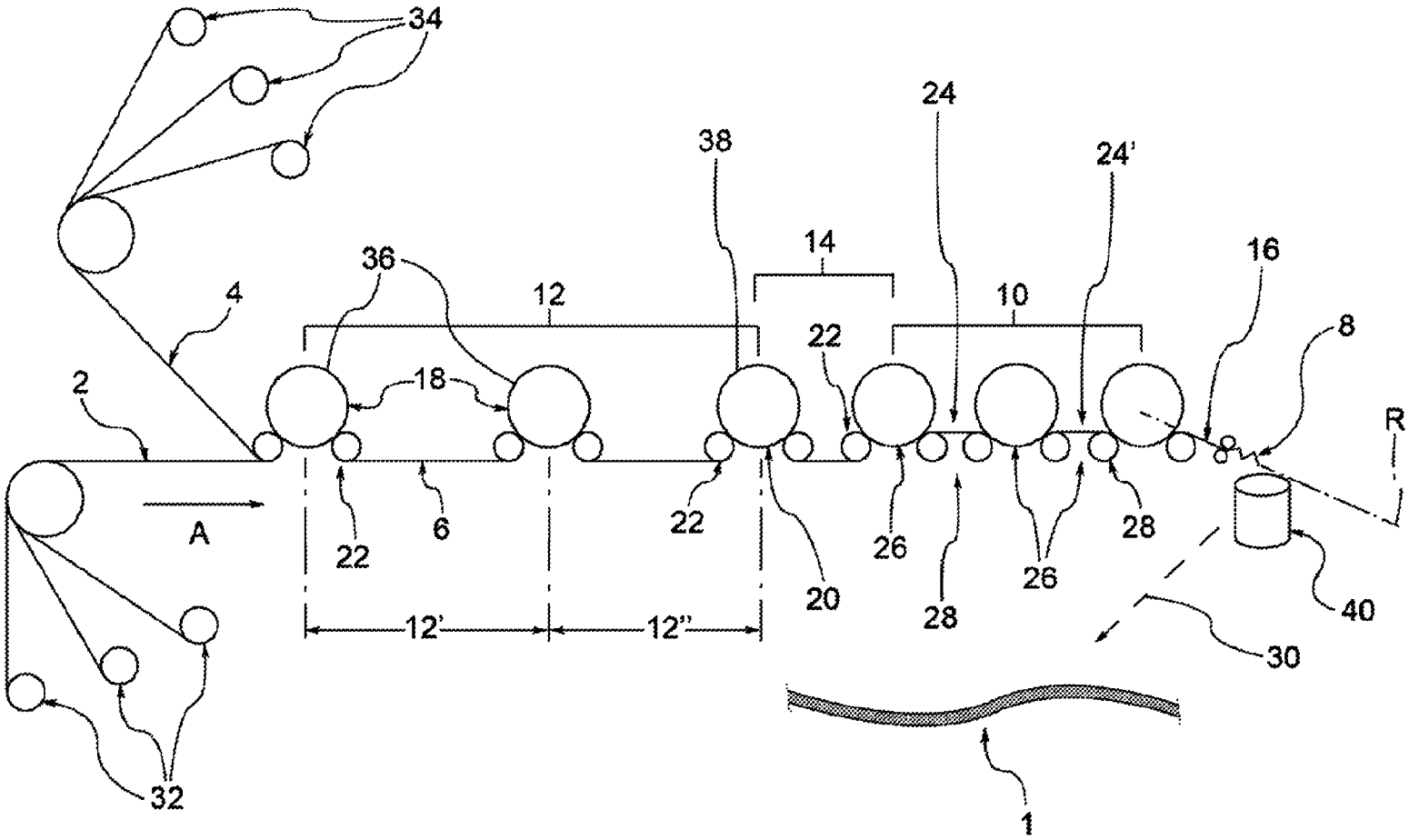
R
8
40
16
30
24'
28
26
10
1
24
28
26
14
22
20
38
22
12''
12
18
6
12'
36
22
34
4
A
2
32

YARNS FOR PROTECTIVE TEXTILES, AND MANUFACTURING METHODS THEREOF

CROSS REFERENCE TO RELATED APPLICATION

This application claims priority to and benefit of Italian Patent Application No. BS2013A000157 filed Oct. 31, 2013, the contents of which are incorporated by reference in their entirety.

FIELD OF THE INVENTION

The present invention relates to yarns for protective textiles, fabrics or garments, processes for manufacturing protective textiles, fabrics or garments at least partially made with the above-mentioned yarn.

BACKGROUND OF THE INVENTION

In order to improve cutting and abrasion-resistance features of yarns for protective garments, it is known to couple continuous or discontinuous filament with high-resistance continuous filaments, for example, filaments of steel or glass. By way of example, Italian patent application no. BS2012A000098 describes a process for obtaining such joining.

Conventionally, high-resistance continuous filaments tend to be external to the thread structure so that, in garments, such filaments do not provide sufficient coverage to obtain satisfactory cutting toughness or resistance in the textile produced with the above-mentioned thread.

Furthermore, since manufactures of continuous filaments only produce those having fixed, predetermined diameters, yarn producers have no choice but to use such filaments in their yarns. As a result, the variety of end counts of the yarns is significantly restricted and there are significant limitations in the options for mixing threads from different producers, which therefore limits the variety of end counts of such producers.

SUMMARY OF THE INVENTION

The present invention provides yarns free from a high-resistance continuous core, wherein mechanical features are ensured by discontinuous fibers of different types, closely mixed together. The present invention also provides methods for making such yarns as well as textiles, fabrics and garments made at least in part from such yarns.

BRIEF DESCRIPTION OF THE FIGURES

FIG. 1 illustrates a representative process according to the present invention.

DETAILED DESCRIPTION

Yarn 1 according to the present invention has abrasion-resistance and cutting-resistance features making it especially suitable for manufacturing protective garments or protective textiles for manufacturing such garments. Such yarn may be specifically designed for manufacturing protective gloves.

In certain embodiments, the count of yarns 1 may be in a range from about 50-100,000 dtex, in other embodiments about 100-50,000 dtex, and in still other embodiments about 100-25,000 dtex.

Methods of making such yarns may include supplying continuous polymer filaments 2 in a feeding direction A, feeding at least one continuous reinforcement filament 4 alongside the polymer filaments 2.

According to certain embodiments, the reinforcement filament 4 may be mixed with, or placed among, the plurality of continuous polymer filaments 2. In such methods a single reinforcement filament may be used.

The continuous polymer filaments 2 may be fed by first supply bobbins 32, and an at least one reinforcement filament may be fed from at least a second feed bobbin 34.

According to such variants, the numerical ratio between the first 32 and second 34 bobbins may affect or determine the final count of the yarn 1. By adjusting the above-mentioned numerical ratio it is possible to obtain other desired features, for example, specifically desired toughness and resistance according to the UNI EN388:2004 standard, a greater or smaller flame resistance, and/or specific dielectric and/or anti-corrosion properties.

In addition, the presence of reinforcement filament 4 in the final yarn 1 may be diluted or concentrated as desired, regardless of the starting linear density determined by the manufacturer of such filament. Specifically, the above-mentioned features of yarn 1 may be designed with high precision based on the linear densities of the starting filaments.

In accordance with various embodiments, the discontinuous polymer fibers 2 may include polyethylene, polyamide, polyester, (para-)aramid, ultra-high molecular weight polyethylene, polyacrylonitrile, (pre-)oxidised polyacrylonitrile and combinations thereof. For example, such fibers 2 may include any of the materials known by the trade names Dyneema®, Kevlar®, Technora® or Panox®.

According to further embodiments, discontinuous polymer fibers, fibers may be of a single type and may include polyethylene, polyamide, polyester, (para-)aramid, ultra-high molecular weight polyethylene, polyacrylonitrile, (pre-)oxidised polyacrylonitrile, or may be combinations of the foregoing.

The at least one continuous reinforcement filament 4 may have a linear density in the range of about 2-25 dtex or about 5-25 dtex. Such density may be determined upon feeding. According to further embodiments, the at least one continuous reinforcement filament 4 may have an average diameter in a range from about 5-50 μm, in further embodiments about 5-30 μm, in still further embodiments about 5-20 μm, for example about 5-15 μm.

The at least one continuous reinforcement filament 4 may independently comprise yarns of glass, steel, carbon fiber or mixtures thereof.

In certain embodiments glass filament is particularly preferred. For embodiments having steel filaments 4, the filament known by the trade name Bekinox®, manufactured by the Belgian company NV Bekaert SA may be used.

In certain embodiments, the at least one continuous reinforcement filament 4 may comprise a filament of steel, and/or a glass yarn selected from, for example, glass of type "E", type "C", type "D", type "R" and mixtures thereof.

The variants with glasses of type "E" and/or type "D" are preferred in certain embodiments, for example, when besides the cutting and/or abrasion resistance properties, dielectric and/or electrical insulation features are also desired.

Variants with glass of type "C" may be particularly suitable for use in environments where corrosive substances are present, thanks to reduced susceptibility to corrosion.

Embodiments with glass of type "R" can provide excellent mechanical properties, for example, in terms of resistance against fatigue, thermal variations, mechanical stresses, cutting forces and/or humidity.

In certain embodiments, methods according to the present invention may further include the detachment of the discontinuous polymer fibers and discontinuous reinforcement fibers from the corresponding filaments 2, 4 so that said detachment of the two types of fibers occurs, at least in part, at the same time and from the same tearing action. As a result a plurality of discontinuous polymer fibers and of discontinuous reinforcement fibers can be obtained to provide a composite sliver 16.

The composite sliver 16 may differ from the sliver precursor 6—which extends more upstream with respect to the feeding direction A—in that the at least one reinforcement filament 4 and the continuous polymer filaments 2 have been fragmented or divided into fibers of shorter length. Thus such filaments would no longer extend continuously in the composite sliver 16.

Advantageously, the step of detaching the above-mentioned continuous filaments 2, 4 proceed simultaneously for some period, so as to create a composite sliver 16 wherein there are discontinuous fibers of different types present, which in some embodiments are mixed together quite closely.

The weight ratio of discontinuous polymer fibers with respect to the discontinuous reinforcement fibers may be in the range from of about 1-99%.

According to certain embodiments, the detachment step may take place by tearing 10 the discontinuous polymer fibers to regularize the average length thereof.

Such tearing step can cause fragmentation in discontinuous fibers having roughly the same average length, and provides normalization of the distribution of lengths of discontinuous fibers.

According to a further embodiment, after tearing 10, the maximum length of the discontinuous polymer fibers 2 may correspond substantially to the average length of the discontinuous reinforcement fibers.

For example, the average length according to above-described variants may be in a range of about 60-200 millimeters or about 80-160 millimeters.

Accordingly, a greater evenness in the size of the discontinuous (both polymer and reinforcement) fibers result, as well as a significant tendency of such fibers to blend and become homogeneous with each other in subsequent manufacturing steps of the yarn.

In accordance with the embodiment depicted in FIG. 1, the detachment step may be preceded by one or more pre-steps of stretching 12, 14 the filaments 2, 4, wherein the latter may be elongated to their yield point.

Accordingly, in such embodiments, the separation of continuous filaments into discontinuous fibers is a gradual, not instantaneous operation, since the filaments are pretreated so as to break at precise moments of the process.

In certain embodiments, at least one pre-step of stretching 12, 14 takes place in the presence of a temperature rise compared to the average temperature or temperatures upstream of said step, for example, compared to the feeding temperature of the filaments.

According to certain variants, the percentage elongation of filaments 2, 4 during the stretching pre-step may be less than about 20%, in other variants less than about 10%, in still other variants less than about 5%, in certain variants over about 1%, for example approximately 2-5% or 3-4%.

More specifically, following the supplying and feeding steps, in certain embodiments methods according to the present invention may provide for a first 12' and a second 12" stretching pre-step, optionally followed by at least one stretching step 14.

Accordingly, during these steps, the count of the sliver precursor 6 may be refined and the irregularities thereof reduced. Concurrently, there also may be mixing of the filaments, and the yield points thereof.

For example, such one or more stretching pre-steps may be conducted using a plurality of pre-stretching 18 and stretching 20 rollers, which act on the sliver precursor 6 with the aid of corresponding counterpressure rollers 22.

For example, pre-stretching 18 and stretching 20 rollers may be heated. In this way, when the filaments pass onto the outer surface 36, 38 thereof, they can be warmed to favour the stretching operation, for example, so as to prevent the filaments from tearing too soon.

The embodiment of FIG. 1 shows at least one supporting rack 24 (for example, a pair of such racks 24, 24' spaced apart along the feeding direction A), at the ends of which tearing calenders 26 may be arranged. Therefore, each rack 24 can delimit a tearing field. In each of such fields, due to the greater angular velocity of the tearing calender more downstream as compared to the preceding angular velocity of the tearing calender, the effects discussed hereinabove may take place.

To this end, in order to define the pinching points of the tearing field, counterpressure calenders 28 may be used to act (pneumatically or mechanically) on the tearing calenders 26.

The methods then may include a step of twisting the composite sliver 16 to obtain a roving 8 from which yarn 1 may be obtained. Such twisting may be performed about a twisting axis R extending along or parallel to the extension direction of the composite sliver 16.

Accordingly, after the composite sliver 16 has been converted into a roving 8 as a result of the above-mentioned twisting (which in this step may be only a moderate twisting), the roving then may be processed into a spinning machine 30—not shown but schematised by the dashed line of FIG. 1—to obtain yarn 1. The roving 8 may be converted into yarn 1 by using a ring spinning machine 30 and, in certain embodiments, in the absence of intermediate processing between the output of the tearing operation 10 and the input into such spinning machine.

Such types of spinning machines have the advantage of preventing further fragmentation of the discontinuous reinforcement fibers, which usually have more limited flexibility compared to corresponding polymer fibers.

Furthermore, the absence of intermediate processing (in contrast to direct processing of the roving) prevents further fragmentation of the most fragile fibers, which would negatively affect the mechanical features of the yarn.

Within the present invention, the term "intermediate processing" generally refers to operations, for example of the mechanical type, which are performed to modify features of the roving, for example the count thereof. Such term does not refer to activities such as collection of the roving in an accumulation container 40, for example, to carry it.

The present invention further includes textiles, fabrics or garments made at least in part from yarn 1 produced by the methods described and claimed herein.

By way of a non-limiting examples, some of the yarns produced by methods according to the present invention are shown in Table 1 below, wherein the abbreviations correspond to UHMWPE=ultra-high molecular weight polyethylene, AR=para-aramid, PA=polyamide, PO=oxidised polyacrylonitrile.

TABLE 1

| Yarn no. | Polymer filament 1 | Polymer filament 2 | Reinforcement filament |
|---|---|---|---|
| 1 | UHMWPE 80% | — | Glass 20% |
| 2 | UHMWPE 90% | — | Glass 10% |
| 3 | AR 70% | — | Glass 30% |
| 4 | PA 70% | — | Glass 50% |
| 5 | PA 50% | — | Steel 50% |
| 6 | AR 30 | PO 60 | Glass 10 |

In accordance with toughness tests conducted on the yarns shown in the table, it was possible to identify an increase in toughness of about 15-20% with respect to corresponding glass-free yarn or steel-free yarn. This demonstrates that yarns of the present invention have improved features compared to the prior art.

Methods and yarns of the present invention are not limited by the need to use only filaments having fixed predetermined diameters according to standard denier ratings. Methods and yarns of the present invention provide a variety of yarns of different features not possible using previously described methods. Such methods and yarns provide any continuous filament count and, in accordance with a further aspect, allow variation in the features of the yarn based on the number of supply bobbins used.

Advantageously, methods of the present invention provide high performance yarn, especially in terms of toughness, resistance against transverse sharing, abrasion and cutting. In particular, such protection is at least comparable to yarns with continuous filaments, which are, however, affected from inconveniences mentioned hereinabove.

Advantageously, the present invention may be implemented with great simplicity in any existing manufacturing line as a result of its constructional simplicity. In fact, introduction of the reinforcement filament during the step of detaching the discontinuous polymer fibers, an operation which necessarily has to be performed on the latter, provides important production savings.

The present invention also provides significant manufacturing savings, since the methods do not require additional or further equipment compared to prior art methods. The present invention also provides products having very high homogenisation of the fibers. Advantageously, the present invention can be performed with virtually no waste of raw materials.

Another important aspect of the present invention relates to the effect that the reinforcement fibers have inside the yarn. In particular, such fibers improve the performance of discontinuous polymer fibers with which the reinforcement fibers are mixed. In fact, even when the nature of the selected polymer filaments is not suitable for ensuring a specific physical feature of the yarn, for example a high toughness, in the presence of discontinuous reinforcement fibers it is possible to increase such property significantly.

By way of example, it is estimated that by mixing reinforcement fibers in glass and discontinuous fibers in polyester (characterised by a low toughness value), it is possible to obtain a significant increase in the toughness of the yarn (e.g. 10% or more).

Without being bound to any particular theory, it is possible that such improvement is due, on the one hand to the even lengths of the fibers, and on the other, to a length of the discontinuous fibers (polymer or reinforcement ones) not lower than 60 or 80 millimeters according to certain embodiments.

A person skilled in the art may make modifications to the methods and yarns described above based on the teachings provided in the present description while still remaining within the scope of the claims.

It should also be noted that each variant described as belonging to a particular embodiment may be implemented independently of the other variants or combined with other embodiments.

What is claimed is:

1. A method for obtaining yarn comprising the steps of:

supplying continuous polymer filaments in a feeding direction;

feeding at least one continuous reinforcement filament, alongside said polymer filaments, wherein the at least one continuous reinforcement filament has a linear density in the range of about 2-25 dtex;

detaching from at least a part of the continuous polymer filaments and the at least one continuous reinforcement filament a plurality of discontinuous polymer fibers and a plurality of discontinuous reinforcement fibers to obtain a composite sliver;

twisting the composite sliver to obtain a roving; and forming yarn from said roving.

2. The method of claim 1, wherein the detachment step comprises tearing of the discontinuous polymer fibers to regularize the average length thereof.

3. The method of claim 2, wherein, after tearing, the maximum length of the discontinuous polymer fibers corresponds substantially to the average length of the discontinuous reinforcement fibers.

4. The method of claim 2, wherein said average length is in the range of about 60-200 millimeters.

5. The method of claim 1, wherein said continuous polymer filaments are fed from first supply bobbins and, said at least one reinforcement filament is fed from at least a second feed bobbin, wherein the numerical ratio between said first and second bobbins determines the final count of said yarn.

6. The method of claim 1, wherein the detachment step is preceded by one or more pre-steps of stretching the filaments, wherein said filaments are elongated to at least their yield point.

7. The method of claim 6, wherein the percentage elongation of the filaments is less than 20%.

8. The method of claim 6, wherein at least one pre-step of stretching takes place in the presence of a temperature rise compared to the average temperature or temperatures upstream of said step.

9. The method of claim 1, wherein the discontinuous polymer fibers are selected from the group consisting of: polyethylene, polyamide, polyester, (para-)aramid, ultra-high molecular weight polyethylene, polyacrylonitrile, (pre-)oxidised polyacrylonitrile and combinations thereof.

10. The method of claim 1, wherein the continuous reinforcement filament comprises steel, and/or glass filaments and wherein said glass filaments are selected from the group consisting of: type "E", type "C", type "D", type "R" and mixtures thereof.

11. The method of claim 1, wherein the weight ratio of the discontinuous polymer fibers to the discontinuous reinforcement fibers is in the range 1-99%, and/or wherein the count of said yarn is in the range of about 50-100,000 dtex.

12. The method of claim 1, wherein a ring spinning machine transforms the roving into yarn without the use of intermediate processing.

13. The method of claim 1, wherein a single continuous reinforcement filament is used.

* * * * *